US006773301B1

(12) United States Patent
Chaskin

(10) Patent No.: US 6,773,301 B1
(45) Date of Patent: Aug. 10, 2004

(54) CELL STRAP FOR COMBINING CELLS INTO A BATTERY

(76) Inventor: Jeffrey R. Chaskin, 841 NW. 126 Ave., Coral Springs, FL (US) 33071

( * ) Notice: Subject to any disclaimer, the term of this patent is extended or adjusted under 35 U.S.C. 154(b) by 0 days.

(21) Appl. No.: 10/431,564

(22) Filed: May 8, 2003

(51) Int. Cl.[7] ..... H01R 3/00
(52) U.S. Cl. ..... 439/500; 429/178
(58) Field of Search ..... 439/500, 627, 439/502, 523; 429/178, 120, 65, 99, 158, 159, 121, 1, 94; 361/760

(56) References Cited

U.S. PATENT DOCUMENTS 5,970,719 A * 10/1999 Merritt ..... 62/3.6
6,010,800 A * 1/2000 Stadnick et al. ..... 429/120
6,265,091 B1 * 7/2001 Pierson et al. ..... 429/1
6,319,631 B1 * 11/2001 Bay et al. ..... 429/178
6,391,489 B1 * 5/2002 Winch et al. ..... 429/121
6,656,632 B2 * 12/2003 Asaka et al. ..... 429/178
6,673,489 B2 * 1/2004 Fong et al. ..... 429/181

* cited by examiner

*Primary Examiner*—Ross Gushi
*Assistant Examiner*—Phuongchi Nguyen
(74) *Attorney, Agent, or Firm*—Kenneth E. Merklen

(57) ABSTRACT

A cell connector bar or strap for connecting or coupling electric cells, both electrically and physically, is provided with a heat-sink for dissipating heat generated by the cells when charging rechargeable cells and during rapid discharge of the battery formed by the coupled cells. The heat-sink, in its preferred structure is a plurality of heat dissipating elements, such as extending fingers, extending from the body of the cell connector bar.

14 Claims, 1 Drawing Sheet

CELL STRAP FOR COMBINING CELLS INTO A BATTERY

BACKGROUND OF THE INVENTION

1. Field of the Invention

The present invention relates to electrically conductive straps or bars that provide both physical and electrical connections between terminals of electric cells, for forming batteries.

2. Prior Art

Electric batteries are made from electric cells. In the process of making an electric battery, a plurality of electric cells, usually referred to as 'dry cells', are electrically and physically combined into the electric battery. The design of an electric cell and the quality of the material from which the cell is made usually determines the electric characteristics of the cell. Battery cells or dry cells are manufactured to meet specific specifications, established by the manufacturer. However, although the dry cells produced in the same manufacturing run by the same manufacturer are designed to have the same materials, specifications and electric characteristics, the electric characteristics vary in quality from cell to cell. A process of cell grading is instituted in order to assemble the cells having substantially similar quality electric characteristics. The highest quality electric battery is a battery combined from electric cells having electric characteristics of high and uniform quality.

Heat is the enemy of electric cells and therefore the enemy of electric batteries made from a plurality of cells. It is most desirable to limit and/or keep heat away from battery cells. In order to connect a plurality of cells into a battery, good physical and electrical connections between cells are required. Contemporary cells are made using metal cans and caps because metal is the best conductor of electricity. In order to connect cells into a battery, a cell bar of metal is used. Most assemblers of batteries heat-solder the cell bar to the cell. Some assemblers spot weld the cell bars to cells with multiple spot welds. The cell bar connection process generates a large amount of heat which is conducted to the cell parts. When electrically charging the cells of a battery, the charging process generates heat and with rapid discharge of the battery, such as used in racing electric vehicles, a great amount of heat is generated. The heating of a cell and the retention of heat by the cell degrades the characteristics of the cell and eventually destroys the electrical functions of the cell.

SUMMARY OF THE INVENTION

The present invention provides an improved cell bar for electrically and physically bridging or connecting each of two cells, in a plurality of cells, for forming a battery. The improved cell bar is defined by a strip or bar of good to excellent electric conductive material, such as copper or gold, for example, and good to excellent heat conductive characteristics, such as copper or nickel, for example. Preferably, a cell bar is defined by a base or center of copper with an integrated exterior of nickel however, a cell bar of solid copper or another combination of good to excellent electric conductive and heat conductive materials may be used, if desired.

The cell bar includes a heat sink, preferably in the form of a plurality of fingers, connected to and/or integrated into and extending from one or more of the side edges of the cell bar and preferably comprised of good to excellent heat conductive material. One or more holes may be made in the heat sink fingers for increasing the surface of the heat sink for more rapid heat dissipation. The holes may be located in the fingers and/or cell bar, as desired. The heat sink fingers preferably are fabricated from good to excellent heat conductive material and extend from the edge of the side of the cell bar. Preferably, the fingers are spaced from each other for good air circulation and heat dissipation. The heat sink fingers may extend from one side of the cell bar or from both sides of the cell bar and may be uniformly spaced or twisted, for inducing air flow, as desired. The heat sink fingers and/or the cell bar may include one or more holes, the diameter of which is less than the thickness of the finger or cell bar, in which the hole is made, so that the surface of the heat sink function is increased for greater and faster heat dissipation. The heat sink fingers may be extended straight or may be curved. The fingers may be extended at the same angle from the cell bar edge or at different angles, with respect to the horizontal and/or the vertical reference.

DETAILED DESCRIPTION OF THE INVENTION

Figure 1B:
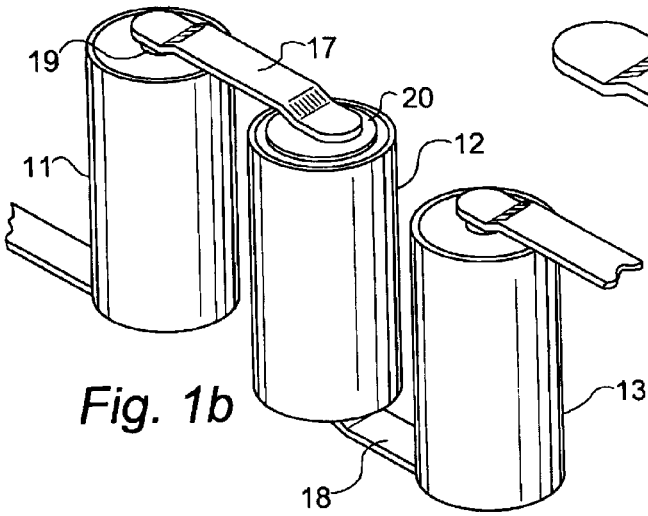
FIGS. 1*a* and 1*b* represent a prior art cell bar and a plurality of cells with connecting cell bars.
Figure 1A:
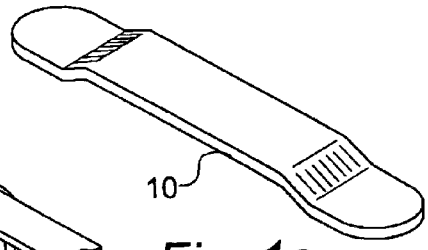
Fig. 1a PRIOR ART

FIGS. 1*a* and 1*b* represent a cell connector bar and use thereof for connecting cells, using prior art technology. A cell connector bar 10 is a metallic strip or bar sufficiently long to make connection, both physically and electrically, with two adjacent cells. Connection may be a series electrical connection or a parallel electrical connection, connecting terminals of adjacently positioned cells, for forming a battery. Cells 11 and 12 are connected by the cell connector bar 17 and cells 12 and 13 are connected by the cell connector bar 18. The cells are connected in a series electrical format. The positive terminal 19 of cell 11 is connected to the negative terminal 20 of cell 12. The positive terminal of cell 12 is connected to the negative terminal of cell 13, in a classic format for providing a battery having voltage that is increased over the voltage of the individual cells. Connection between the cell connector bar and the cell may be accomplished by heat soldering or welding, as is well known in the art. While electrically connecting cells 11 and 12, for example, the cell connecting bar or strip also hold cells 11 and 12 physically oriented, with respect to each other. The cell connector bar 18 connects cells 12 and 13 both electrically and physically.

Figure 2:
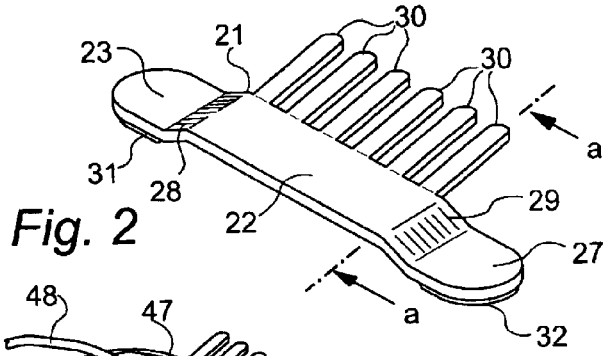
FIG. 2 is a representation of the invention, in pictorial view.

FIGS. 2, 2*a*, 3 and 4 represent aspects of the present invention and use of the invention. Electrically and physically connecting two cells, in series connection. FIG. 2 represents a preferred embodiment of the invention, where a cell connector bar or strap 21 includes a body 22 and appended feet 23 and 27. Between each foot 23 and 27 and the body 21 are canted areas 28 and 29 respectively, that raise the body above and over rims of cells when the cell bar is connected to each of two cells, essentially bridging the cells. Extending from, or connected to the side of the body 22 of the cell connector bar 21 are a plurality of spaced heat-sink elements or fingers 30. Preferably, the fingers 30 are each an extension of the body 22, spaced for permitting air flow between the fingers for defining a heat-sink element.

The cell connector bar may be a solid material, such as copper, for example or may be a clad or coated material, such as a core of copper, for example and a coating of steel. The heat-sink fingers, which may be extensions of the body or connected to the body, may be fabricated from the same material from which the body is fabricated. In a preferred embodiment, the body and feet of the cell connector bar are fabricated from a metal core of copper, which is an excellent electric conductor and includes a coating or is clad with a material which is an excellent conductor of heat. The fingers of the heat-sink are fabricated from the coating or clad material for more efficient heat dissipation. If desired, a layer of solder material 31 and 32 may be pressed or rolled on to the under surface of each foot 23 and 27, respectfully, for soldering purposes.

Figure 2A:
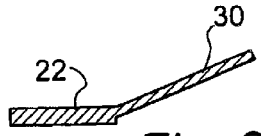
FIG. 2*a* is a cross section view of part of the invention represented in FIG. 2, along line a—a thereof.

FIG. 2*a* is a view of the invention represented in FIG. 2 along the line a—a, showing the fingers 30 extending angularly from the body 22 of the connector bar. The fingers 30 may extend out straight or may be angled, as represented. The fingers may be uniformly elevated or elevated at different angles, as desired. The fingers 30 may be straight or twisted to vary the air space between the fingers, for more efficient heat dissipation. When the connector bar is fabricated from clad materials, one material having greater electric conducting characteristics than heat dispensing characteristics and a second material having greater heat dispensing characteristics than electric conducting characteristics, the fingers are preferably extensions of and are fabricated from the material having the best heat dispensing characteristics.

Figure 3:
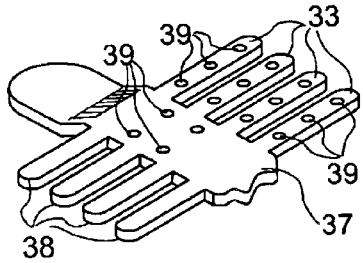
FIG. 3 represents an alternate embodiment of the invention.
Figure 3A:
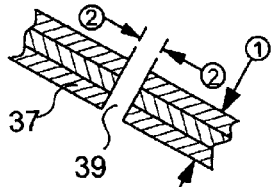
FIG. 3*a* represents a cross-cut view of surface-increasing holes, represented in FIG. 3.

FIG. 3 represents an alternate embodiment of the invention in which heat-sink fingers 33 extend from one side of the body 37 and heat-sink fingers 38 extend from the other side of the body 37. In addition, the heat-sink members 33 and the body 37 are provided with holes, 39, which extend between the surfaces thereof. As represented in FIG. 3*a*, the holes 39 have a diameter (2—2) which is inferior to the thickness of the body 37 (1—1), for increasing the surface of the material forming the body and forming the fingers for more efficient heat dissipating purposes. FIG. 3*a* also represents that the body may be fabricated from a clad material, that is, the center material of the body and the feet may be copper, for example and the outer material or cover may be steel, for example.

The function of the cell connector bar is primarily to conduct electricity between cells. It is well established that copper is an excellent conductor of electricity and copper is a preferred material for forming cell connector bars. Further, is well known that low voltage electricity travels primarily on the inside of a conductor making copper metal the preferred metallic core of a bi-metallic cell connector bar. As is also well known, steel, though a conductor of electricity is inferior to copper, as a conductor of electricity but superior to copper as a conductor of heat. Thus, a steel clad/copper core fabrication is a preferred combination for a clad cell connector bar, although other combinations of materials may be used, if desired.

Figure 4:
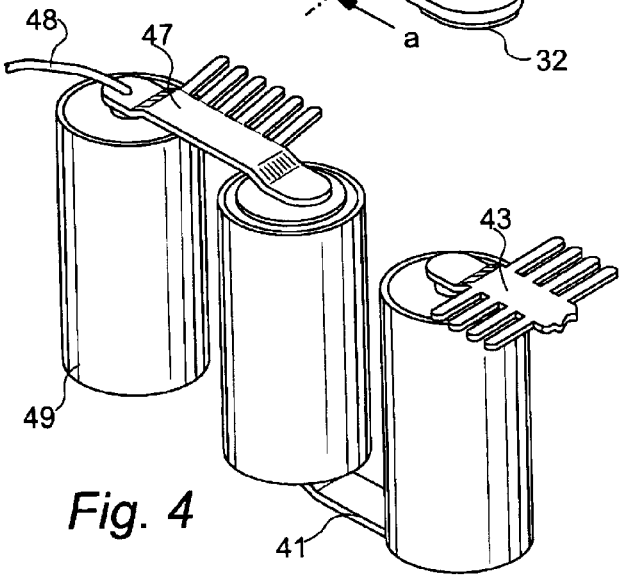
FIG. 4 represents a plurality of cells individually connected using the present invention.

FIG. 4 represents the use of the invention in connecting a plurality of cess into a battery. A cell connector bar 47, with a single heat-sink member may be used or a cell connector bar 43, with a double heat-sink member may be used to connect cells. The cell connector bar 41 may include heat-sink fingers which extend from the far side of the body of the bar.

It will be apparent to one skilled in the art that the terminal 48, extending from the positive terminal of cell 49, may represent one terminal, the positive terminal, of a battery and that the second or negative terminal of the battery is not shown.

In the foregoing description of the invention, referenced to the drawings, certain terms have been used for conciseness, clarity and comprehension. However, no unnecessary limitations are to be implied from or because of the terms used, beyond the requirements of the prior art, because such terms are used for descriptive purposes and are intended to be broadly construed. Furthermore, the description and illustration of the invention are by way of example, and the scope of the invention is not limited to the exact details shown, represented or described.

Having now described a preferred embodiment of the invention, in terms of features, discoveries and principles, along with certain alternative construction and suggested changes, other changes that may become apparent to those skilled in the art may be made, without departing from the scope of the invention defined in the appended claims.

What is claimed is:

1. An apparatus for electrically coupling two electric cells for defining a battery where each electric cell of said two electric cells include a positive terminal and a negative terminal, said apparatus comprising:

a) a body having a first extreme and a second extreme, said first extreme for making contact with a terminal on a first electric cell and said second extreme for making contact with a terminal on a second electric cell for making an electric connection between said first electric cell and said second electric cell; and b) a heat-sink coupled to said body, said heat-sink defined by one or more finger members extending from said body.

2. An apparatus for electrically coupling two electric cells for defining a battery where each electric cell of said two electric cells include a positive terminal and a negative terminal, said apparatus comprising:

a) a body having a first extreme and a second extreme, said first extreme for making contact with a terminal on a first electric cell and said second extreme for making contact with a terminal on a second electric cell for making an electric connection between said first electric cell and said second electric cell; and b) a heat-sink coupled to said body, and said body has a length between said first extreme and said second extreme and a width extending along said length and said heat-sink includes a plurality of spaced fingers extending from said width of said body.

3. An apparatus for electrically coupling two electric cells for defining a battery where each electric cell of said two electric cells include a positive terminal and a negative terminal, said apparatus comprising:

a) a body having a first extreme and a second extreme, said first extreme for making contact with a terminal on a first electric cell and said second extreme for making contact with a terminal on a second electric cell for making an electric connection between said first electric cell and said second electric cell; and b) a heat-sink coupled to said body, and said heat-sink is defined by a plurality of spaced fingers extending from said body and at least one finger of said spaced fingers is disposed angularly from said body with respect to a horizontal.

4. An apparatus for electrically coupling two electric cells for defining a battery where each electric cell of said two electric cells include a positive terminal and a negative terminal, said apparatus comprising:

a) a body having a first extreme and a second extreme, said first extreme for making contact with a terminal on a first electric cell and said second extreme for making contact with a terminal on a second electric cell for making an electric connection between said first electric cell and said second electric cell; and b) a heat-sink coupled to said body, and said body has a length between said first extreme and said second extreme and a width extending along said body, said width defined by a first side edge and a second side edge and said heat-sink is defined by a plurality of spaced fingers extending from said first side edge.

5. An apparatus as in claim 4 and in which said heat-sink further includes a second plurality of spaced fingers.

6. An apparatus as in claim 5 wherein said second plurality of spaced fingers extend from said second side edge.

7. An improved cell connector bar for connecting terminals of at least two electric cells each cell of said two electric cells having a first terminal and a second terminal, said cell connector bar comprising:

a) a body having a length defines by a first extreme and a second extreme, said length having a width defined by a first side and a second side; and b) a heat-sink defined by at least a member extending from said first side of said body and said at least a member extending from said first side of said body is defined by a plurality of spaced members extending from said first side.

8. An improved cell connector bar as in claim 7 and in which said heat-sink further includes at least a second member extending from said second side of said body.

9. An improved cell connector bar as in claim 8 and in which said at least a second member is defined by a plurality of spaced members extending from said second side of said body.

10. An improved electric cell connector bar for connecting at least two electric cells for defining a battery where each cell of said at least two electric cells include a first terminal and a second terminal and said improved electric cell connector bar connects two of said at least two electric cells both electrically and physically, said electric cell connector bar comprising:

a) a body having a length defined by a first extended foot and a second extended foot, said length having a width defined by a first edge and a second edge, said body fabricated from a material having an electric conductor characteristics and an heat conductor characteristics; and b) a heat-sink defined by at least a member extending from said first edge, fabricated from said material.

11. An improved electric cell connector bar as in claim 10 and in which said heat-sink further includes at least a second member extending from said second edge of said body.

12. An improved electric cell connector bar as in claim 10 wherein said body is a clad member defined by at least a core of a first material having first electric conductor characteristics and second heat conductor characteristics and a cover of a second material having third electric characteristics and fourth heat conductor characteristics and said at least said member extending from said first edge is fabricated from said second material.

13. An improved cell connector bar as in claim 12 and in which said heat-sink is defined as a first member extending from said first edge and fabricated from said second material and a second member extending from said second edge and fabricated from said second material.

14. An improved cell connector bar as in claim 12 and in which said at least said member extending from said first edge is a plurality of spaced fingers.

* * * * *